US005199958A

United States Patent [19]

Jenkins et al.

[11] Patent Number: 5,199,958

[45] Date of Patent: Apr. 6, 1993

[54] STAIN RESISTANT MULTICOLOR TEXTURED CUT PILE CARPET: CATIONIC-DYEABLE NYLON YARN DYED WITH ANIONIC DYES AND ANIONIC-DYEABLE NYLON YARN

[75] Inventors: William G. Jenkins, Lexington; Roy E. Guess, Roanoke, both of Va.

[73] Assignee: Burlington Industries Inc., Greensboro, N.C.

[21] Appl. No.: 732,201

[22] Filed: Jul. 19, 1991

Related U.S. Application Data

[63] Continuation-in-part of Ser. No. 552,178, Jul. 12, 1990, Pat. No. 5,085,667, which is a continuation of Ser. No. 519,237, May 4, 1990, abandoned.

[51] Int. Cl.[5] ..... D06P 3/06; D06P 3/82

[52] U.S. Cl. ..... 8/539; 8/481; 8/483; 8/530; 8/531; 8/680; 8/685; 8/924; 8/929

[58] Field of Search ..... 8/539, 481, 483

[56] References Cited

U.S. PATENT DOCUMENTS

| | | | |
|---|---|---|---|
| 4,043,749 | 8/1977 | Huffman | 8/531 |
| 4,579,762 | 4/1986 | Ucci | 428/95 |
| 4,592,940 | 6/1986 | Blyth et al. | 252/8.75 |
| 4,780,099 | 10/1988 | Greschler et al. | 8/115.6 |
| 5,085,667 | 2/1992 | Jenkins | 8/539 |

FOREIGN PATENT DOCUMENTS

| | | |
|---|---|---|
| 01-221574 | 9/1989 | Japan . |
| 01-223908 | 9/1989 | Japan . |
| 01-260061 | 10/1989 | Japan . |
| 1-272885 | 10/1989 | Japan . |

*Primary Examiner*—A. Lionel Clingman
*Attorney, Agent, or Firm*—Nixon & Vanderhye

[57] ABSTRACT

Multicolored stain-resistant nylon carpet is prepared by tufting a space dyed cationic-dyeable carpet nylon, dyed with an acid or premetalized dye intermixed and tufted with an acid dyeable nylon and overdyed with an acid dye to selectively dye the acid dyeable fibers but not the already space dyed yarns.

5 Claims, No Drawings

STAIN RESISTANT MULTICOLOR TEXTURED CUT PILE CARPET: CATIONIC-DYEABLE NYLON YARN DYED WITH ANIONIC DYES AND ANIONIC-DYEABLE NYLON YARN

CROSS-REFERENCE TO RELATED APPLICATIONS

This application is a continuation-in-part of earlier application Ser. No. 07/552,178 filed Jul. 12, 1990 now U.S. Pat. No. 5,085,667 issued Feb. 4, 1992 which, in turn, is a continuation of earlier application Ser. No. 07/519,237, filed May 4, 1990, now abandoned.

This invention relates to textured, heathered, multicolored carpet having improved stain resistance, lightfastness and ozone resistance of nylon, especially nylon carpet.

BACKGROUND OF THE INVENTION

Stain resistant nylon carpets enjoy significant market acceptance. Stain resistance is typically imparted to nylon by treating the fiber as a solid filament or in a carpet form by the topical application of a chemical finish as described in the following U.S. patents to Monsanto: U.S. Pat. Nos. 4,501,591; 4,592,940; and 4,839,212. The low acid pH necessary to fix this stain resistant finish has the adverse property of greatly altering the shade of the cationic dye which is normally used on this cationic dyeable fiber, precluding its use as a styling factor to obtain multicolor effects in subsequent carpet. However, by using cationic dyeable nylon, which has been previously dyed with acid dyes, in either a solid shade or, preferably, space printed to give multiple short spacings of color, this complication is overcome.

Nylon carpet fiber is generally classified as to type, depending upon its receptivity to acid dyes and basic or cationic dyes. Cationic dyeable nylons contain sufficient $SO_3H$ groups or COOH groups within the polymer structure, which groups are receptive to cationic or basic dyes to render the fiber dyeable to a cationic dye. Acid dyeable nylons are essentially conventional nylons, such as polyhexamethylene adipamide and polycaprolactam. Acid dyeable nylons vary as to type and are characterized as being weakly dyed with acid dyes, average dyed with acid dyes, or deeply dyed with acid dyes.

Cationic dyeable nylons generally exhibit inherent stain resistant properties, especially to acid-type stains, as compared to other nylon types used for carpet. Cationic dyeable nylons are dyeable with selected cationic dyes, but suffer from poorer lightfastness, especially in light shades, than do comparable shades dyed on acid dyeable nylon using monosulfonated or premetalized acid dyes. This has resulted in the under-utilization of cationic dyeable nylon as a carpet fiber. The fiber's inherently useful properties which otherwise make it attractive as a carpet fiber previously have not been fully realized.

Initial dyeing is accomplished using the space dyeing or intermittent dyeing technique in which the yarn within a given area or space is dyed a particular color, the color and spaces varying throughout the length of the yarn according to random or predetermined orders.

Dyeing carpet yarn is described in U.S. Pat. No. 4,206,735 which relates to a carpet prepared by space dyeing a polyester or polypropylene yarn then tufting the space dyed yarn with another yarn, undyed and having a susceptibility to a dye to which the polyester or polypropylene space dyeing yarn is not susceptible, followed by dyeing the undyed yarn taking care that the selective dyeability of the undyed yarn does not interfere with the previously space dyed yarn. Tak dyeing is used to provide coloration for the nylon tufts and Tak dyeing is explained in U.S. Pat. No. 4,146,362.

Another type of space dyeing is described in U.S. Pat. No. 4,033,717 to Whitaker in which a continuous filament yarn is knit into a prefabric such as a tube or a sock, selectively dyed in a predetermined pattern using various colors, then deknitted, wound onto cones and heated to develop the color. This is also known as a knit/deknit process. When tufted into a carpet, the tufts of the space dyed yarn are arranged randomly or preferably in predetermined blocks or areas.

Research Disclosure 17913 (March 1979) uses the space dyed yarns of the Whitaker patent, combines them with undyed yarns, then overdyes to a different color to provide a carpet having different color combinations. Space dyed yarns may also be prepared using "resist" techniques to treat the fabric to "resist" the type of dye employed, as described in Jilla, U.S. Pat. No. 3,989,453.

Piece dyeing carpets using carpet pile made from two or more different classes of yarns, one yarn being susceptible to one type of dyeing and the other class of yarns susceptible to a different type of dye, is described in U.S. Pat. No. 3,439,999.

DETAILED DESCRIPTION OF THE INVENTION

This invention provides a procedure for preparing stain resistant carpet having an attractive multicolored appearance.

A multicolored carpet is created according to this invention using cationic dyeable nylon yarn, which has been space dyed or printed to multiple colors with premetalized or acid dyes. This multicolored yarn is combined with acid dyeable nylon yarn, tufted into a carpet, then overdyed with an acid dye. The acid dye fixes to the acid dyeable nylon but not the cationic dyeable nylon leaving the multicolored spaced dyed yarn clear and distinct against a contrasting field of solid color yarns. Variations in the colors of the multicolored cationic dyeable nylon yarn, the shade of the background acid dyeable nylon yarn, the relative amounts and positioning of the two types of yarn, their construction into a carpet and other factors all provide styling variations.

The preferred techniques for dyeing the cationic dyeable nylon yarns include exhaust dyeing, pad/steam dyeing, continuous carpet dyeing and the like. Illustrative examples for dyeing procedures thought to be suited to the process of this invention are:

| Pad/Steam - A dye bath is prepared as follows: | |
|---|---|
| guar gum (Celcagum V-60) | 0.3% |
| antifoam (Sedgekill AO) | 0.15% |
| wetting/penetrating agent (Dyebath SS-75) | 0.7% |
| premetalized acid dyestuff (pH adjusted to 6.0 with monosodium phosphate) | as required |

and applied to the cationic dyeable nylon at wet pickup of 90 to 140% based on the weight of the yarn. For proper fixation, the yarn is steamed for 6 to 12 minutes then washed, extracted, treated with a fluorochemical soil repellant and dried.

Exhaust Dyeing—an aqueous dyebath is prepared containing the required amount of premetalized acid dyestuff, the pH adjusted to 6.0 with monosodium phosphate and, optionally, up to 0.5% Irgasol SW, a weakly cationic complexing agent which retards the strike of the acid dye by complexing with the dye and then slowly releasing the dye to the fiber as the temperature rises, is added. The dyebath temperature, initially at 80° F., is increased at a rate of 2° F. per minute to 140° F. and held there for 15 minutes, then raised again at 2° F. per minute to 208°-212° F. Cationic dyeable nylon is then exhaust dyed for 30 to 60 minutes or longer as needed to achieve the desired depth of shade.

Illustrative cationic dyeable nylons include:

| | Filament: | | |
|---|---|---|---|
| DuPont | Monsanto | Allied | BASF |
| "Antron" Type 924 | "Ultron" 2360-68-JEJ | | |
| "Antron" Type 494 | | "Anso" Type 7L422 | |
| "Antron" Type 754 | | "Anso" Type 7K53 | |
| "Antron" Type 854 | | | |
| "Antron" Type P695 | | | |
| "Antron Lumena" Type P-807A | | | |
| Nylon Staple: | | | |
| "Antron" P-676A | "Ultron"-750-JES | "Anso" Type 591 | "Zeftron" W118S |
| "Antron" P-683A | | | |
| "Antron" 543A | | | |
| "Antron" 547A | | | |

An affinity for cationic dyes is usually imparted the incorporation of a monomer containing sulfonic acid groups. Thus one such modification of a polyamide fiber is obtained by adding a certain amount of sulphoisophthalic acid prior to polymerization.

Premetalized and acid dyes considered suited to the process are selected from the following list:

| Trade Name | Manufacturer | Color Index Name | Number |
|---|---|---|---|
| Amichrome | | | |
| Black RB | ICI | Acid Black 63 | — |
| Red RB | " | Acid Red 226 | — |
| Atalan | | | |
| Fast Orange YF | ATL | Acid Orange 69 | — |
| Orange GRE | " | Acid Orange 62 | — |
| Yellow GR | " | Acid Yellow 99 | 13900 |
| Inochrome | | | |
| Black BNI | ICI | Acid Black 52 | — |
| Intrachrome | | | |
| Black RPL | C&K | — | — |
| Black WA Ex Conc | " | Acid Black 52 | 15711 |
| Bordeaux RM | " | Acid Red 194 | — |
| Grey RC | " | Acid Black 127 | — |
| Orange G | " | Acid Orange 74 | — |
| Yellow GR Conc | " | Acid Yellow 99 | 13900 |
| Intralan | | | |
| Black BGL 150% | " | Acid Black 107 | — |
| Black M-RL | " | Acid Black 194 | — |
| Bordeaux M-B | " | Acid Violet 90 | — |
| Brilliant Yellow 3GL | " | Acid Yellow 127 | — |
| Dark Blue M-BR | " | — | — |
| Red Brown RW | " | — | — |
| Gray BL 200% | " | Acid Black 60 | — |
| Navy NLF | " | — | — |

-continued

| Trade Name | Manufacturer | Color Index Name | Number |
|---|---|---|---|
| Orange RDL | " | Acid Orange 60 | 18732 |
| Yellow 2GL Extra | " | Acid Yellow 129 | — |
| Yellow GL-S | " | — | — |
| Yellow NW | " | Acid Yellow 151 | 13906 |
| Irgalan | | | |
| Black BGL | Ciba-Geigy | Acid Blk 107 | — |
| Black GBL | " | — | — |
| Black RBL | " | Acid Black 132 | — |
| Bordeaux EL | " | Acid Red 251 | — |
| Bordeaux GRL 200% | " | Acid Red 213 | — |
| Brown 2RL | " | Acid Brown 45 | — |
| Gray BL | " | Acid Black 58 | — |
| Gray BRLA | " | Acid Black 60 | — |
| Olive 3BL | " | Acid Green 70 | — |
| Orange 2RL | " | Acid Orange 60 | — |
| Orange RL | " | Acid Orange 86 | — |
| Red B 200% | " | Acid Red 182 | — |
| Red 2GL | " | Acid Red 211 | — |
| Yellow DRL | " | Acid Yellow 151 | 13906 |
| Yellow 2GL | " | Acid Yellow 129 | — |
| Irganol | | | |
| Brilliant Yellow 3GLS | Ciba-Geigy | Acid Yellow 127 | — |
| Isolan | | | |
| Black RL, Liq | Mobay | Acid Black 139 | — |
| Bordeaux R 220% | " | Acid Red 182 | — |
| Brown S-RL | " | Acid Brown 413 | — |
| Grey KP-BL 200 | " | — | — |
| Navy Blue S-RL | " | Acid Blue 335 | — |
| Red S-RL | " | Acid Red 414 | — |
| Yellow K-PRL 200% | " | Acid Yellow 137 | — |
| Yellow NW 250% | " | Acid Yellow 151 | 13906 |
| Yellow S-GL | " | Acid Yellow 232 | — |
| Lanaperl | | | |
| Blue GN 200 | Hoechst | Acid Blue 41 | — |
| Blue GN | " | Acid Blue 40 | 62125 |
| Fast Navy Blue R 200 | " | Acid Blue 113 | — |
| Turquoise Blue GL | " | — | — |
| Lanasyn | | | |
| Black BGL 200% | Sandoz | Acid Black 131 | — |
| Black BRL 200% | " | Acid Black 132 | — |
| Black S-DL, Liq | " | Acid Black 194 | — |
| Black S-GL, Liq | " | Acid Black 222 | — |
| Black S-RL, Liq | " | Acid Black 218 | — |
| Bordeaux GRL | " | Acid Red 213 | — |
| Bordeaux RL | " | Acid Red 217 | — |
| Brown 2GL | " | Acid Brown 304 | — |
| Carbon BL | " | Acid Black 170 | — |
| Dark Brown S-BL | " | Acid Brown 289 | — |
| Dark Brown S-GL | " | Acid Brown 298 | — |
| Grey BL | " | Acid Black 58 | — |
| Grey BLR | " | Acid Black 60 | 18165 |
| Navy S-BL, Liq | " | Acid Blue 296 | — |
| Navy S-DNL | " | — | — |
| Olive Green S-4GL | " | Acid Green 106 | — |
| Olive S-2GL | " | Acid Green 106 | — |
| Orange S-RL | " | Acid Orange 168 | — |
| Red 2GLN | " | Acid Red 404 | — |
| Red S-G, Liq | " | Acid Red 399 | — |
| Rubine S-5BL | " | Acid Violet 125 | — |
| Yellow LNW | " | Acid Yellow 151 | 13906 |
| Yellow 2RL | " | Acid Orange 80 | — |
| Yellow S-2GL, Liq | " | Acid Yellow 235 | — |
| Levalan | | | |
| Brown I-BRL Cold SOL | Mobay | Acid Brown 330 | — |
| Dark Brown I-TL | " | Acid Brown 331 | — |
| Neolan | | | |
| Black WA | Ciba-Geigy | Acid Black 52 | 15711 |
| Blue 2G Conc | " | Acid Blue 158 | 14880 |
| Bordeaux RM 133% | " | Acid Red 194 | — |
| Orange G | " | Acid Orange 74 | 18745 |
| Pink BNA 300% | " | Acid Red 186 | 18810 |
| Yellow GR | " | Acid Yellow 99 | 13900 |
| Neutrichrome | | | |
| M Black M-R | ICI | Acid Black 194 | — |
| M Bordeaux M-B | " | Acid Violet 90 | 18762 |
| M Navy M-BD | " | — | — |

-continued

| Trade Name | Manufacturer | Color Index Name | Number |
|---|---|---|---|
| M Yellow M-3R | " | Acid Brown 384 | — |
| Neutrichrome | | | |
| S Black S-2B | " | Acid Black 224 | — |
| S Bordeaux S-BD | " | Acid Violet 121 | — |
| S Brown S-2R | " | Acid Brown 357 | — |
| S Grey S-BG | " | Acid Black 188 | — |
| S Navy S-B | " | Acid Blue 284 | — |
| S Navy S-NA | " | — | — |
| S Orange S-R | " | Acid Orange 144 | — |
| S Red S-G | " | Acid Red 359 | — |
| S Yellow S-GR | " | Acid Yellow 121 | 18690 |
| S Yellow S-5R | " | Acid Orange 120 | — |
| Orcolan | | | |
| Fast Black WAN Ex | ORC | Acid Black 52 | 15711 |
| Fast Blue GGN | " | Acid Blue 158 | 15050 |
| Fast Orange GEN | " | Acid Orange 74 | 18745 |
| Fast Orange GLE-S | " | Acid Orange 62 | — |
| Fast Red RN | " | Acid Red 183 | — |
| Fast Yellow BELN | " | Acid Yellow 54 | 19010 |
| Fast Yellow GRN | " | Acid Yellow 99 | 13900 |
| Neutral Black BGL | " | Acid Black 107 | — |
| Neutral Black BR | " | Acid Black 194 | — |
| Neutral Black EKC Ex Conc | " | Acid Black 164 | — |
| Neutral Black LDS | " | — | — |
| Neutral Blue GL | " | Acid Blue 127 | 61135 |
| Neutral Bordeaux BSB | " | Acid Violet 90 | 18762 |
| Neutral Brilliant Yellow 5G | " | Acid Yellow 127 | — |
| Neutral Brown BRL | " | — | — |
| Neutral Brown 2GL | " | Acid Brown 44 | — |
| Neutral Brown GRS | " | Acid Brown 282 | — |
| Neutral Brown 2RL | " | Acid Brown 45 | — |
| Neutral Dark Blue BR | " | Acid Blue 193 | 15707 |
| Neutral Grey B | " | Acid Black 60 | — |
| Neutral Grey BLGY-N | " | Acid Black 58 | — |
| Neutral Orange NR | " | Acid Orange 60 | — |
| Neutral Orange RL 250% | " | Acid Orange 86 | — |
| Neutral Red B | " | Acid Red 182 | — |
| Neutral Yellow EKL Ex Conc | ORC | Acid Yellow 121 | — |
| Neutral Yellow 2GL Ex | " | Acid Yellow 129 | — |
| Neutral Yellow GLSN | " | Acid Yellow 114 | — |
| Neutral Yellow WN 250% | " | Acid Yellow 151 | — |
| The following level dyeing acid dyes are thought to work particularly in the light depths but do not build very well as strength is increased: | | | |
| Nylanthrene | | | |
| Black GLRT | C&K | — | — |
| Black GLWC | " | — | — |
| Blue B-AR 67% Liq | " | — | — |
| Blue B-AR 200% | " | — | — |
| Blue B-GA | " | — | — |
| Blue B-NB | " | — | — |
| Blue GLF | " | — | — |
| Blue LGGL | " | — | — |
| Brilliant Blue 3BLF | " | — | — |
| Brilliant Blue 2RFF | " | — | — |
| Brilliant Yellow 4NGL | " | Acid Yellow 49 | — |
| Brilliant Yellow B-NGL | " | — | — |
| Brilliant Yellow B-4RK | " | Acid Yellow 219:1 | — |
| Brilliant Yellow CGL p.a.f. | " | — | — |
| Brown RSM | " | — | — |
| Navy LFWG | " | — | — |
| Orange B-GN | " | — | — |
| Orange 3G | " | Acid Orange 156 | — |
| Orange SLF Conc | " | Acid Orange 116 | — |

-continued

| Trade Name | Manufacturer | Color Index Name | Number |
|---|---|---|---|
| Pink BLRF (pat) | " | — | — |
| Red B-2B | " | — | — |
| Red B-2BSA | " | Acid Red 266 | — |
| Red B-CLN Conc | " | — | — |
| Red 2RDF | " | — | — |
| Red 4RL (pat) | " | — | — |
| Rubine 5BLF | " | Acid Red 299 | — |
| Scarlet B-YKS | " | — | — |
| Scarlet GYL Ex (pat) | " | — | — |
| Scarlet YDL p.a.f. | " | — | — |
| Yellow FLW | " | Acid Yellow 159 | — |
| Yellow RAR Liq | " | Acid Yellow 152 | — |
| Yellow SL 200% | " | Acid Yellow 198 | — |
| Yellow SL Liq | " | Acid Yellow 198 | — |
| Nylomine | | | |
| Black D-2R | ICI | Acid Black 172 | — |
| Blue A-G Conc Grains | " | Acid Blue 25 | 62055 |
| Blue A-2R | " | Acid Blue 62 | 62045 |
| Blue B-3G | " | Acid Blue 40 | 62125 |
| Blue C-B | " | Acid Blue 127:1 | — |
| Blue C-2G | " | Acid Blue 175 | — |
| Blue C-3R | " | Acid Blue 140 | — |
| Bordeaux C-B | " | Acid Red 128 | 24125 |
| Bordeaux C-3B | " | Acid Red 119 | — |
| Green C-G | " | Acid Green 27 | 61580 |
| Green C-3G | " | Acid Green 28 | — |
| Navy C-2R | " | Acid Blue 113 | 26360 |
| Red A-B | " | Acid Red 396 | — |
| Red A-2B 100% | " | Acid Red 266 | — |
| Red B-3B | " | Acid Red 57 | — |
| Red C-2B | " | Acid Red 138 | 18073 |
| Red C-BA | " | Acid Red 249 | 18134 |
| Red C-G | " | Acid Red 151 | — |
| Violet C-B | " | Acid Violet 48 | — |
| Yellow A-G | " | Acid Yellow 135 | — |
| Yellow A-G 33% Pst | " | Acid Yellow 135 | — |
| Yellow A-2GA 200% | " | Acid Yellow 49 | — |
| Yellow A-4R 150 | " | Acid Yellow 199 | — |
| Nylosan | | | |
| Blue 2AL/C-2AL | Sandoz | Acid Blue 25 | 62055 |
| Blue E/C-BGL 200% | " | — | — |
| Blue E/C-BRL | " | Acid Blue 288 | — |
| Blue E/C-GL | " | Acid Blue 72 | — |
| Blue F-GBL | " | Acid Blue 127:1 | — |
| Blue F-L | " | Acid Blue 80 | 61585 |
| Blue F-RL | Sandoz | Acid Blue 247 | — |
| Blue N-BLN | " | — | — |
| Blue N-5GL 200% | " | Acid Blue 280 | — |
| Blue PRL | " | Acid Blue 129 | — |
| Bordeaux E-2BL | " | Acid Red 301 | — |
| Bordeaux N-BL | " | Acid Red 119 | — |
| Brilliant Blue N-FL | " | Acid Blue 278 | — |
| Brilliant Green F-6GL | " | Acid Green 28 | — |
| Brown N-2R | " | Acid Orange 51 | 26550 |
| Green F-BL, 200% | " | Acid Green 40 | — |
| Navy N-RBL Conc | " | Acid Blue 113 | 26360 |
| Orange C-GNS/E-GNS Pat | " | Acid Orange 156 | — |
| Orange E-2GL | " | Mord Orange 6 | 26520 |
| Orange N-RL | " | Acid Orange 127 | — |
| Red E-BM | " | — | — |
| Red F-5B | " | Acid Red 143 | — |
| Red F-BR | " | Acid Red 167 | — |
| Red F-2R/C-2R | " | Acid Red 151 | 26900 |
| Red F-RL | " | Acid Red 263 | — |
| Red F-RS, Conc | " | Acid Red 114 | 23635 |
| Red N-2RBL | Sandoz | Acid Red 336 | — |
| Rubine N-5BL, 200% | " | Acid Red 299 | — |
| Scarlet F-3GL | " | Acid Red 111 | 23266 |
| Violet F-BL | " | Acid Violet 48 | — |
| Yellow N-7GL | " | Acid Yellow 218 | — |
| Yellow N-3RL | " | Acid Orange 67 | — |
| Tectilon | | | |
| Black GD | Ciba-Geigy | — | — |
| Blue 4GN | " | Acid Blue 343 | — |

-continued

| Trade Name | Manufacturer | Color Index Name | Number |
|---|---|---|---|
| Blue GRL | " | Acid Blue 25 | 62055 |
| Blue 5GS | " | — | — |
| Blue 4R | " | Acid Blue 277 | — |
| Floxine KL 220% | " | Acid Red 257 | — |
| Orange 3G | " | Acid Orange 156 | — |
| Orange 3R | " | — | — |
| Orange 4R | " | — | — |
| Red 2B | " | Acid Red 361 | — |
| Red GR | " | Acid Red 73 | 27290 |
| Yellow 2G | " | Acid Yellow 169 | — |
| Yellow 4R | " | Acid Yellow 219 | — |
| Telon | | | |
| Blue ANL | Mobay | Acid Blue 25 | 62055 |
| Blue ANL Liq 33 | " | Acid Blue 25 | — |
| Blue BL 125 | " | Acid Blue 78 | 62105 |
| Blue BRL 200 | " | Acid Blue 324 | — |
| Blue BRL Disp 67 | " | Acid Blue 324 | — |
| Blue BRL Liq 67 | " | Acid Blue 324 | — |
| Blue CD-FG | " | Acid Blue 145 | 23905 |
| Blue 2GL 200 | " | Acid Blue 40 | 62125 |
| Blue 2GL Disp 50 | " | Acid Blue 40 | 62125 |
| Blue 4GL | " | — | — |
| Blue RRL 182 | " | Acid Blue 62 | 62045 |
| Fast Black LD | " | Acid Black 172 | — |
| Fast Black LG Liq 40 | " | — | — |
| Fast Black NW | " | — | — |
| Fast Blue A-FN | " | Acid Blue 264 | — |
| Fast Blue A-3GL | " | Acid Blue 290 | — |
| Fast Blue A-RW | " | Acid Blue 205 | — |
| Fast Blue ESN | " | Acid Blue 221 | — |
| Fast Blue 5G | " | Acid Blue 232 | — |
| Fast Blue GL 200 | " | Acid Blue 102 | 50320 |
| Fast Blue GGN | " | Acid Blue 127:1 | — |
| Fast Blue RLW | " | Acid Blue 204 | — |
| Fast Green BW | " | Acid Green 84 | — |
| Fast Navy Blue R 182 | " | Acid Blue 113 | 26360 |
| Fast Navy Blue RF | " | Acid Blue 113 | 26360 |
| Fast Orange A-RTL 200 | " | Acid Orange 116 | — |
| Fast Red A-FG | " | Acid Red 360 | — |
| Fast Red BRL 200 | " | Acid Red 260 | — |
| Fast Red 3BW | " | Acid Red 274 | — |
| Fast Red ER | " | Acid Red 158 | 20530 |
| Fast Red GN | Mobay | Acid Red 111 | 23266 |
| Fast Rubine A5BL 167 | " | — | — |
| Fast Rubine A-5BLW | " | Acid Red 299 | — |
| Fast Violet A-BB | " | Acid Violet 103 | — |
| Fast Yellow A-3GL | " | Acid Yellow 216 | — |
| Fast Yellow A-3RL | " | — | — |
| Fast Yellow 4GL 175 | " | Acid Yellow 79 | — |
| Red 2BL 200 | " | Acid Red 266 | — |
| Red 2BL Liq 33 | " | Acid Red 266 | — |
| Red 2BL Disp 67 | " | Acid Red 266 | — |
| Red BR-CL Disp 83 | " | — | — |
| Red BR-CL 250 | " | — | — |
| Red CD-R | " | Acid Red 395 | — |
| Red FL 200 | " | Acid Red 337 | — |
| Red FL Liq 33 | " | Acid Red 337 | — |
| Red FL Disp 67 | " | Acid Red 337 | — |
| Yellow FGL 200 | " | Acid Yellow 49 | — |
| Yellow FGL Liq 66 | " | Acid Yellow 49 | — |
| Yellow K-RNL 200 | " | Acid Yellow 230 | — |
| Yellow Brown 3GL | " | Acid Brown 248 | — |

EXAMPLE 1

Cationic dyeable yarn (Antron type 854) knit into a tube was continuously dyed in a laboratory Ilma pad/steam unit with 100% wet pickup with the indicated premetalized dyes depending upon the shade desired, then steamed for approximately 8 minutes to provide the desired base shade. The base shade-dyed tube was then overprinted using a silk screen process:

Pad baths for the background shade were

| | | |
|---|---|---|
| Gray: | Irgalan Bordeaux EL | .015% |
| | Irgalan Yellow 3RL | .015% |
| | Irgalan Blue 3RL | .1487% |
| | Dyebath SS-75 | .7% |

Each pad bath also included Celcagum V-60 (0.3%) and Dyebath SS-75 (0.7%) and was adjusted to pH 6 with MSP.

Print pastes in 4 shades were prepared from a base of thickener (Lyngum CP-3) 2.35%, penetrant (Tergitol) 1%, an antifoaming agent (Antifoam CK-2) 0.15% and adjusted to pH 6.0 with MSP. Dyes used for the 4 shades were:

| | |
|---|---|
| dark gold: | Irgalan Yellow 3RL 1% |
| bright blue: | Irgalan Brilliant Blue 7GS 0.25% |
| burgandy: | Irgalan Bordeaux EL 200% 1% |
| green: | Irgalan Brilliant Blue 7GS 0.25%<br>Irgalan Yellow 3RL 0.25% |

The printed samples were fixed with steam, washed and dried. The print design was satisfactorily fixed to the nylon tube with good crockfastness. This dyed and space printed product offers a styling versatility advantage over solution dyed nylon, in which pigment is extruded with the polymer, by allowing multiple colors on one yarn while maintaining the antistaining advantage inherent in cationically dyed nylon yarns.

Additionally a skein of "Antron Lumena" P-807A solution pigmented yarn in which colored pigment is incorporated into the polymer prior to extrusion into filament form) which also exhibits cationic dyeable properties, was printed with the same dark gold, bright blue and burgundy formulation above. This was followed by fifteen minutes atmospheric steaming at 210° F., washing and drying. The resulting overprint with the premetalized acid dye was judged to have acceptable crock fastness and performance as a product styling tool.

EXAMPLE 2

Three different space dyed ("Duracolor") single yarns (premetalized acid dyes on cationic Dupont type 494A Antron) prepared in the manner of Example 1 were plied with a natural regular acid dyeable type 1608 Monsanto nylon singles yarn. All three yarns were then Superba Frieze heat set to lock in the twist. The three different heatset yarns were then tufted into carpet in an A, B, C needle thread up.

The resulting carpet was then overdyed on the laboratory Kuster dye range using two different methods:

(A) Wet out with water followed by Kuster flood application of a solid shade acid dye formula.

(B) A thin gum layer of 1000–2000 cps viscosity was applied to the tips of the carpet followed by a Kuster flood shade similar to A above.

Dye Formulation:

| | | | |
|---|---|---|---|
| (A) | Wet Out: | | Water pH 4.0 |
| | Flood shade: | .17% | "Progacyl" D49 DW* |
| | | .30% | Z-Wet wetting agent |
| | | .40% | Dyebath ACB |
| | | .20% | Monosodium Phosphate |
| | | | Monosulfonated acid dyes pH 4.0; |
| | | 400% | wet pickup |
| (B) | Gum Layer: | .85% | "Progacyl" D-49 DW* |
| | | .25% | Antifoam CK-2 |

-continued

| | | |
|---|---|---|
| | .20% | MSP (monosodium phosphate) |
| | 2.0% | Penetrant SDP-2 |
| Kuster Flood: | .20% | "Progacyl" D-49 DW* |
| | 2.0% | Formic acid |
| | .30% | Penetrant KB |
| | .10% | Antifoam CK-2 |
| | | Monosulfonated acid dyes |

*a derivatized guar gum thickener of Rhone-Poulenc

Similar carpets were tufted using different yarns all containing a cationic dyeable nylon space dyed with premetalized acid or acid dyestuffs plied with a greige regular acid dyeable nylon.

What is claimed is:

1. A process of preparing a stain resistant multicolored carpet comprising the successive steps of:

(a) space dyeing a cationic-dyeable nylon yarn with an acid dye or a premetalized acid dye at a pH of from about 4.0 to 6.5 and fixing the dye to the fibers, the cationic dyeable nylon yarn dyed into predetermined colors, a predetermined pattern,.or both, to intermittently dye the yarn different colors along the length thereof;

(b) tufting the space dyed yarns of step (a) and an acid dyeable nylon yarn having an affinity to acid dyes into a carpet; and (c) dyeing the carpet prepared in step (b) with an amount of acid dye sufficient to selectively dye only the acid dyeable nylon fibers and not the previously space dyed cationic dyeable nylon fibers, to produce a multicolored stain resistant carpet.

2. The process of claim 1, in which a premetalized acid dye is used in step (a).

3. The process of claim 1, in which an acid dye is used in step (a).

4. The process of claim 1, including the additional step of (d) applying a fluorocarbon soil repellant to the carpet.

5. A multicolored nylon textured cut pile carpet having improved stain resistance composed of space dyed cationic dyeable nylon yarn dyed to two or more different shades with an acid or premetalized acid dye intermixed and tufted with an acid dyeable nylon dyed to a background shade with an acid dye.

* * * * *

UNITED STATES PATENT AND TRADEMARK OFFICE

CERTIFICATE OF CORRECTION

PATENT NO. : 5,199,958
DATED : April 6, 1993
INVENTOR(S) : JENKINS et al

It is certified that error appears in the above-identified patent and that said letters patent is hereby corrected as shown below:

Column 8, line 4, change "Irgalan Blue 3RL" to read --Irgalan blue 3GL--.

Column 8, lines 18 and 20, change "Irgalan Brilliant Blue 7GS" to --Irganol Brilliant Blue 7GS--.

Signed and Sealed this

Twenty-fifth Day of February, 1997

*Attest:*

*Attesting Officer*

BRUCE LEHMAN

*Commissioner of Patents and Trademarks*